US006478038B1

(12) United States Patent
Le Gette et al.

(10) Patent No.: US 6,478,038 B1
(45) Date of Patent: Nov. 12, 2002

(54) COLLAPSIBLE SHADE FOR A TOWEL MAT

(75) Inventors: Brian Edward Le Gette, Severna Park, MD (US); Justin Saul Werner, Millersville, MD (US)

(73) Assignee: Gray Matter Holdings, LLC, Baltimore, MD (US)

( * ) Notice: Subject to any disclaimer, the term of this patent is extended or adjusted under 35 U.S.C. 154(b) by 12 days.

(21) Appl. No.: 09/632,946

(22) Filed: Aug. 4, 2000

(51) Int. Cl.[7] ..... A47G 9/06; E04H 15/02; E04H 15/44

(52) U.S. Cl. ..... 135/96; 135/126; 135/136; 135/137; 135/143; 135/148; 135/155; 5/417; 5/418; 5/419

(58) Field of Search ..... 5/417, 418, 419; 135/96, 124, 125, 126, 132, 133, 134, 136, 137, 138, 143, 148, 150, 155

(56) References Cited

U.S. PATENT DOCUMENTS

| | | | | |
|---|---|---|---|---|
| 368,206 | A | * 8/1887 | Hardy | |
| 722,801 | A | 3/1903 | Bourne, Jr. | |
| 1,047,163 | A | 12/1912 | Bullock | |
| 1,479,903 | A | 1/1924 | Erland | |
| 2,036,033 | A | * 3/1936 | Fisher | |
| 2,109,881 | A | 3/1938 | Goldberg | 5/344 |
| 2,190,566 | A | 2/1940 | Julian | 135/5 |
| 2,243,982 | A | 6/1941 | Seeley | |
| 2,266,853 | A | * 12/1941 | Dabney | |
| 2,344,010 | A | 3/1944 | Walsh | 2/69 |
| 2,357,789 | A | 9/1944 | Levy | 5/339 |
| 2,442,105 | A | 5/1948 | Vacheron | 2/69.5 |
| 2,637,861 | A | 5/1953 | Kethledge | 5/339 |
| 2,731,997 | A | 1/1956 | Muth et al. | 150/11 |
| 2,870,464 | A | 1/1959 | Lalick | 5/334 |
| 2,874,385 | A | 2/1959 | Wade | |
| 2,875,771 | A | 3/1959 | Brewin | 135/1 |
| 2,932,833 | A | 4/1960 | Wambach | 5/337 |
| 2,961,802 | A | 11/1960 | Mongan et al. | |
| 3,052,895 | A | 9/1962 | Lo Vico | 5/344 |
| 3,255,467 | A | 6/1966 | Kowalski | 5/121 |
| 3,336,610 | A | 8/1967 | Geddings | 5/344 |
| D210,181 | S | 2/1968 | Solomon | |
| 3,640,296 | A | 2/1972 | Huddle | 135/4 R |
| 3,675,667 | A | 7/1972 | Miller | 135/1 R |
| 3,717,888 | A | 2/1973 | Phelan | 5/343 |
| 3,780,379 | A | 12/1973 | Kampman | |
| 3,840,919 | A | 10/1974 | Middleton | 5/343 |
| 3,862,876 | A | 1/1975 | Graves | 161/44 |
| 3,899,853 | A | 8/1975 | Wertman | 52/2 |
| 3,960,161 | A | 6/1976 | Norman | 135/1 |
| 3,990,463 | A | 11/1976 | Norman | 135/4 |
| 4,068,674 | A | 1/1978 | Mitchell | 135/14 D |
| 4,097,944 | A | 7/1978 | Yulish | 5/344 |
| 4,122,847 | A | 10/1978 | Craig | |
| 4,200,942 | A | 5/1980 | Case | 5/419 |
| 4,231,125 | A | 11/1980 | Tittl | 5/419 |
| 4,232,692 | A | 11/1980 | Atkins | 135/5.1 |
| 4,236,543 | A | 12/1980 | Moss | 135/3 R |
| D261,404 | S | 10/1981 | Smith | D6/265 |

(List continued on next page.)

FOREIGN PATENT DOCUMENTS

| | | |
|---|---|---|
| EP | 0 928 865 A1 | 7/1999 |
| EP | 0 974 293 A2 | 1/2000 |
| EP | 1 043 049 A2 | 10/2000 |
| JP | 3-21779 | 1/1991 |

OTHER PUBLICATIONS

"The Undercover Sunshade," Delta, U.S.A., black and white photograph of advertisement packaging.

*Primary Examiner*—Robert Canfield
(74) *Attorney, Agent, or Firm*—Cooley Godward LLP

(57) ABSTRACT

A screen includes a collapsible frame member having an arcuate member, and a strut member extending from the arcuate member such that a substantially three legged structure is formed. A covering extends between opposite sides of the arcuate member around the strut member.

11 Claims, 9 Drawing Sheets

U.S. PATENT DOCUMENTS

D261,407 S 10/1981 Moss
4,296,788 A 10/1981 Slater ..... 150/52
4,440,187 A 4/1984 Fiddler ..... 135/117
4,466,517 A * 8/1984 Spiegelman
4,512,049 A 4/1985 Henry ..... 5/417
4,531,330 A 7/1985 Phillips ..... 52/2
4,561,480 A 12/1985 Underwood et al. ..... 150/49
4,599,754 A * 7/1986 Maiirs, III et al. ..... 135/96
D287,041 S 12/1986 Gitchel et al.
4,641,379 A 2/1987 Martin
4,644,588 A 2/1987 Zawacki
D288,613 S 3/1987 James et al.
D292,438 S 10/1987 Lyke
4,709,430 A 12/1987 Nicoll ..... 5/417
4,739,784 A 4/1988 Fast ..... 135/117
4,785,838 A 11/1988 Negahdari ..... 135/117
4,796,734 A * 1/1989 Distasio
4,815,784 A 3/1989 Zheng ..... 296/97.7
4,821,353 A 4/1989 Neri ..... 5/418
4,825,892 A 5/1989 Norman ..... 135/104
4,858,634 A 8/1989 McLeese ..... 135/104
4,865,381 A 9/1989 Van Rogue ..... 297/184
4,876,829 A 10/1989 Mattick ..... 52/2
4,881,565 A 11/1989 Turk ..... 135/101
D306,762 S 3/1990 Aquino ..... D25/56
D307,338 S 4/1990 Vandeputte
4,915,120 A 4/1990 Ziolkowski ..... 135/90
4,951,333 A * 8/1990 Kaiser et al. ..... 5/417
4,969,500 A * 11/1990 Makosa ..... 160/135
5,024,262 A 6/1991 Huang ..... 160/370.2
D318,706 S 7/1991 Norman
5,038,812 A 8/1991 Norman ..... 135/104
5,056,172 A 10/1991 Kaiser et al.
5,059,463 A 10/1991 Peters ..... 428/65
D326,134 S 5/1992 Norman
5,116,273 A 5/1992 Chan ..... 160/370.2
5,116,288 A * 5/1992 Kondo et al.
5,135,281 A 8/1992 Pappalardo ..... 297/184
5,137,044 A 8/1992 Brady ..... 135/104
5,163,192 A 11/1992 Watson ..... 5/419
5,163,461 A 11/1992 Ivanovich et al. ..... 135/104
5,213,147 A 5/1993 Zheng
5,215,109 A * 6/1993 Kent
D340,549 S 10/1993 Russell
D341,407 S 11/1993 McLeese
5,313,666 A 5/1994 Bax et al.
5,320,405 A 6/1994 Foster et al. ..... 297/184.17
D349,593 S 8/1994 Hensley ..... D34/1
5,345,627 A 9/1994 Cammarata ..... 5/419
5,385,165 A 1/1995 Hazinski et al.
5,396,917 A 3/1995 Hazinski et al. ..... 135/104
5,403,220 A 4/1995 Goad, Sr.
5,411,046 A 5/1995 Wan ..... 135/126
5,427,381 A 6/1995 Macaluso et al.
5,433,433 A 7/1995 Armell
5,435,025 A 7/1995 Gerard et al. ..... 5/419
5,439,017 A 8/1995 Brown
5,439,018 A 8/1995 Tsai
5,452,934 A 9/1995 Zheng
5,454,643 A 10/1995 Sullivan ..... 383/4
5,467,794 A 11/1995 Zheng ..... 135/125
5,528,779 A * 6/1996 Lee et al. ..... 5/413
5,533,653 A 7/1996 Kaufman ..... 224/577
D374,512 S 10/1996 Kiley et al. ..... D30/459
5,560,385 A 10/1996 Zheng ..... 135/125
5,569,094 A 10/1996 Macaluso
5,579,799 A 12/1996 Zheng ..... 135/126
5,592,961 A 1/1997 Chin
5,601,105 A 2/1997 Blen et al.
5,618,110 A 4/1997 Sullivan ..... 383/4
5,618,246 A 4/1997 Zheng ..... 482/35
D379,487 S 5/1997 Gale
5,629,071 A 5/1997 Feldman ..... 428/192
5,638,852 A 6/1997 Dean ..... 135/136
RE35,571 E 7/1997 McLeese ..... 135/126
5,642,750 A 7/1997 Brown et al.
5,644,807 A 7/1997 Battistella ..... 5/419
5,645,096 A 7/1997 Hazinkski et al.
D384,382 S 9/1997 Armell
5,664,596 A 9/1997 Zheng
5,676,168 A * 10/1997 Price ..... 135/126
5,688,052 A 11/1997 Compton ..... 383/38
5,690,134 A * 11/1997 McCauley ..... 135/133
5,693,398 A 12/1997 Granger ..... 428/66.7
5,722,446 A 3/1998 Zheng
5,730,529 A 3/1998 Fritz et al. ..... 383/4
5,730,666 A 3/1998 Hudson
5,769,022 A 6/1998 Luxford
5,778,915 A 7/1998 Zheng ..... 135/126
5,800,067 A 9/1998 Easter
5,816,278 A 10/1998 Kim
5,816,279 A 10/1998 Zheng
5,816,954 A 10/1998 Zheng
5,823,217 A 10/1998 Rice ..... 135/124
D400,949 S 11/1998 Gale
5,833,310 A * 11/1998 LaBelle ..... 297/184.1
D401,983 S 12/1998 Lowenthal
5,842,940 A 12/1998 Macaluso
D412,354 S 7/1999 Takos
5,927,311 A 7/1999 Jager ..... 135/124
5,941,265 A 8/1999 Zheng ..... 135/125
5,950,649 A 9/1999 Gerig
5,976,023 A 11/1999 Cho
5,987,822 A 11/1999 McNiff et al. ..... 52/2.11
D425,958 S 5/2000 DePasquale
6,062,243 A 5/2000 Tuch et al.
D426,415 S 6/2000 Le Gette et al.
6,073,283 A 6/2000 Zheng
6,095,172 A * 8/2000 Trapp et al. ..... 135/96
6,098,349 A * 8/2000 Zheng ..... 52/126
6,109,281 A * 8/2000 Lowenthal ..... 135/125
6,109,282 A 8/2000 Yoon
6,192,635 B1 2/2001 Zheng
6,199,229 B1 3/2001 Wong
6,260,304 B1 7/2001 Swetish et al.
6,312,434 B1 11/2001 Cho
6,343,391 B1 * 2/2002 LLe Gette et al. ..... 5/417
6,349,732 B1 * 2/2002 Cooper ..... 135/133

* cited by examiner

COLLAPSIBLE SHADE FOR A TOWEL MAT

BACKGROUND OF THE INVENTION

The present invention generally relates to shades, and more particularly to collapsible shades.

Shades for use with chairs and mats are typically used, for example, to protect a person from direct sunlight and/or wind and rain. Difficulty exists, however, in transporting, assembling, and disassembling these items when being used for such purposes. Known shades exist having large frames, which are difficult to assemble, as well as shades having frames with numerous components that present assembly difficulties.

Several attempts have been made to remedy some of the problems existing with known shades. For example, some patents disclose inflatable tents or shades that are integral with the bases over which they extend. Such devices, however, are not as versatile as may be desired by consumers. Also, collapsible sun shades and tents exist with complex frame structures that are difficult to collapse or expand.

SUMMARY OF THE INVENTION

A screen includes a collapsible frame member having an arcuate member, and a strut member extending from the arcuate member such that a substantially three legged structure is formed. A covering extends between opposite sides of the arcuate member around the strut member.

The accompanying drawings are included to provide a further understanding of the invention and are incorporated in and constitute a part of this specification, illustrate several embodiments of the invention and together with the description serve to explain the principles of the invention.

BREIF DESCRIPTION OF THE DRAWINGS

DETAILED DESCRIPTION

Figure 1:
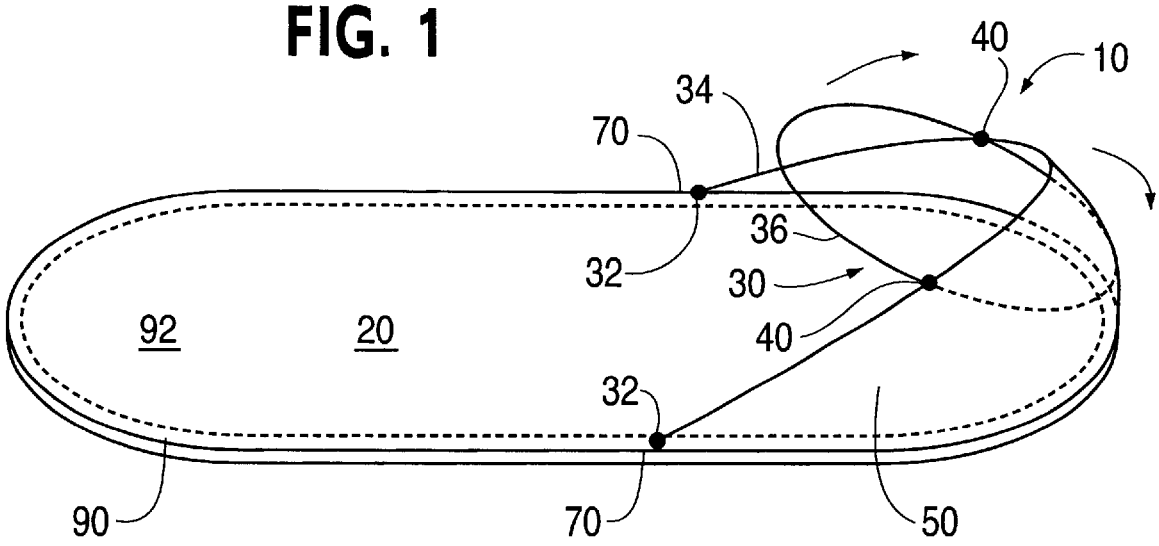
FIG. 1 shows a perspective view of the apparatus according to an embodiment of the present invention.
Figure 2:
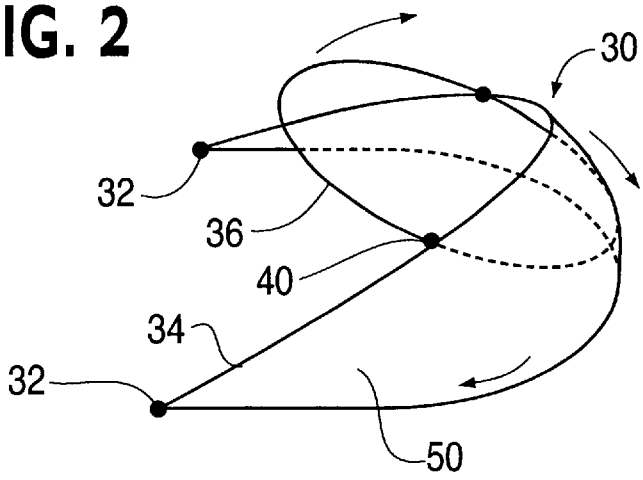
FIG. 2 shows a perspective view of a shade of the apparatus shown in FIG. 1.
Figure 3:
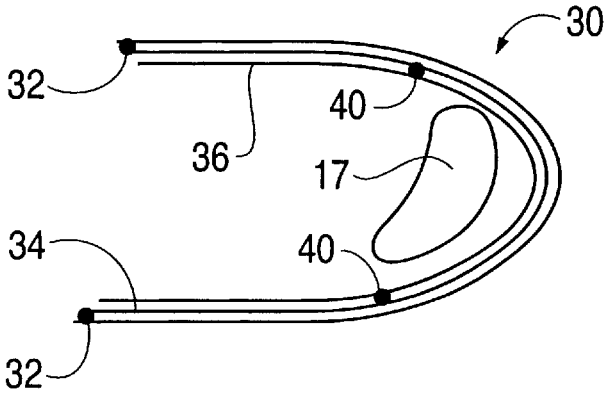
FIG. 3 shows a perspective view of the shade of FIG. 2 in a collapsed configuration.

Reference will now be made in detail to embodiments of the invention, examples of which are illustrated in the accompanying drawings. Referring to FIGS. 1–3, a screen or shade 10 is removably attachable to a ground cover 20 such as a towel or a mat and includes a collapsible frame 30 having pivotable connectors 32 coupleable with the ground cover 20. The collapsible frame 30 has a first frame member 34 having a substantially arcuate shape, and a second frame member 36 that is pivotally coupled with the first frame member 34 at a pair of pivot points 40. The pivot points 40 are separate from the pivotable connectors 32. A covering 50 surrounds a portion of the collapsible frame 30 such that the collapsible frame 30 and covering 50 together are formable as an enclosure. Covering 50 can be substantially opaque, but can include a portion of covering 50 that is vented to allow air to pass through. Such a configuration, for example, prevents the shade 10 from being carried away by a strong wind. The material comprising the covering 50 may include, for example, mesh, vinyl, cloth, or the like.

As illustrated in FIGS. 2 and 3, the first frame member 34 and the second frame member 36 are arrangeable in at least one of a collapsed configuration (FIG. 3) and an expanded configuration (FIG. 2) (and intermediate configurations between the collapsed and expanded configurations. In the collapsed configuration, the first frame member 34 and the second frame member 36 are substantially coplanar. In the expanded configuration, the first frame member 34, and the second frame member 36 are offset from each other. In the collapsed configuration, the second frame member 36 is elongated such that it is essentially concentric with the first frame member 34. In the expanded configuration, the second frame member 36 becomes substantially circular in configuration. The shape of the second frame member 36 is primarily defined by the covering 50 that surrounds the collapsible frame 30. The covering 50 can be securely fit around the collapsible frame 30 such that a taut configuration is provided to maintain the shape of the structure.

It can be desirable to provide a pillow 17, or similar cushion to be used with the shade 10 of the present invention. The pillow 17 can be removably attached to the shade 10 via a tether (not shown) or other such construction. For example, where the shade 10 is attached to a mat 20, the pillow 17 can be coupled to the mat 20 and/or the shade 10. The pillow 17 may also serve as the sole attachment point for the shade 10 to the mat 20. For example, the pillow 17 may be tethered to the shade 10 and also removably coupled to the mat 20 by, for example, a hook and pile attachment.

A first collapsible frame 90 can be formed from a flexible twistable material.

Examples of such frames are disclosed in U.S. applications Ser. Nos. 09/081,134; 09/229,968; and 09/390,317, all of which are incorporated herein by reference. The first collapsible frame 90 can have a plurality of attachment points 70 to which a second collapsible frame 30 may attach. A membrane 92 can be removably attachable to the first collapsible frame 90.

The second collapsible frame 30 can have connectors 32 that are removably attachable to the plurality of attachment points 70. A covering 50 can be coupled with the second collapsible frame 30, such that the second collapsible frame 30 and the covering 50 together are formable as an enclosure above the membrane 92.

The second collapsible frame 30 that can be coupled to the first collapsible frame 90 has a first frame member 34 having a substantially arcuate shape, and a second frame member 36 that is pivotally coupled with the first frame member 34 at a pair of pivot points 40. The pivot points 40 are separate from the pivotable connectors 32.

As illustrated in FIGS. 2 and 3, the first frame member 34 and the second frame member 36 are arrangeable in one of a collapsed configuration (FIG. 3) and an expanded configuration (FIG. 2). In the collapsed configuration, the first frame member 34 and the second frame member 36 are substantially coplanar. In the expanded configuration, the first frame member 34, and the second frame member 36 are offset from each other. In the collapsed configuration, the second frame member 36 is elongated such that it is essentially concentric with the first frame member 34. In the expanded configuration, the second frame member 36 becomes substantially circular in configuration. The shape of the second frame member 36 is primarily defined by the covering 50 that surrounds the second collapsible frame 30. The covering 50 can securely fit around the second collapsible frame 30 such that a taut configuration is provided to maintain the shape of the structure. The covering 50 may also be dimensioned such that it is slidably engageable with the first collapsible frame 90 to secure the second collapsible frame 30 thereto.

Figure 5:
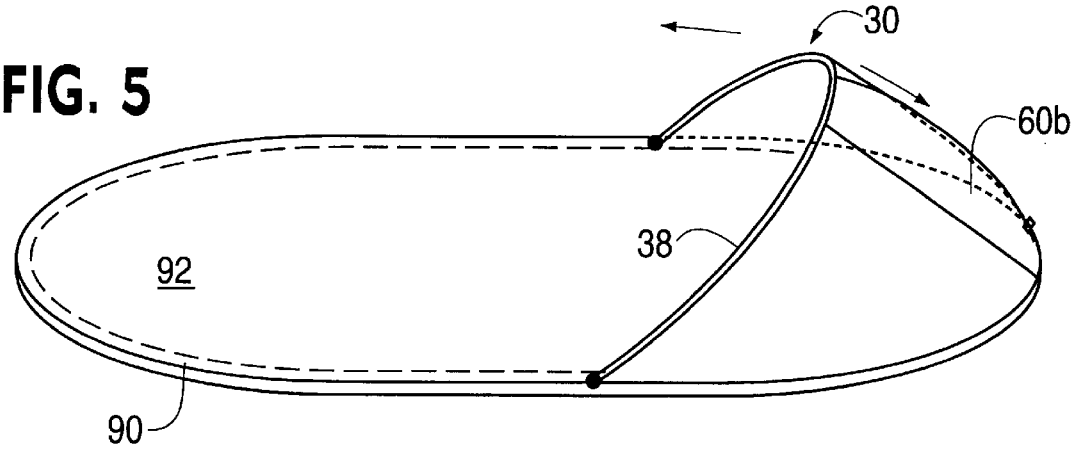
FIG. 5 shows a perspective view of the apparatus according to a further embodiment of the present invention.
Figure 6:
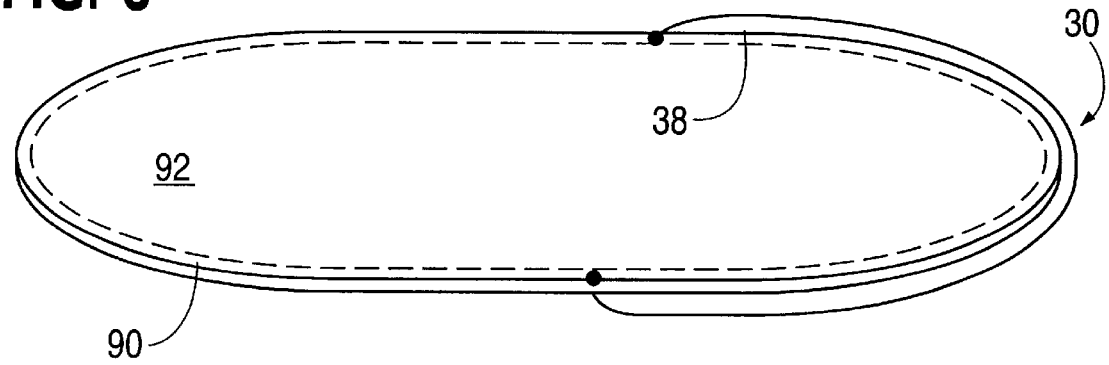
FIG. 6 shows a perspective view of an apparatus shown in FIG. 5 with a shade in the collapsed configuration.

Referring to FIGS. 5–6, in another embodiment of the present invention, the second collapsible frame 30 comprises at least one support element 38 coupled to opposite sides of the first collapsible frame 90, such that the second collapsible frame 30 is arrangeable in one of a collapsed configuration (FIG. 6) and an expanded configuration (FIG. 5). In the collapsed configuration, the support element 38 substantially engages, or is coplanar with, the membrane 92 that surrounds the first collapsible frame 90. In the expanded configuration, the support element 38 is substantially displaced from the membrane 92.

To maintain the support element 38 in the expanded configuration, a retainer 60 can be coupled to the support element 38. For example, in one embodiment of the present invention, the retainer 60 may include a detent mechanism (not shown) in pivotable connectors 32. Such a mechanism can allow the support element 38 to be maintained at various heights above the ground or ground cover, thus varying the amount of shade provided by the apparatus 10.

Figure 4:
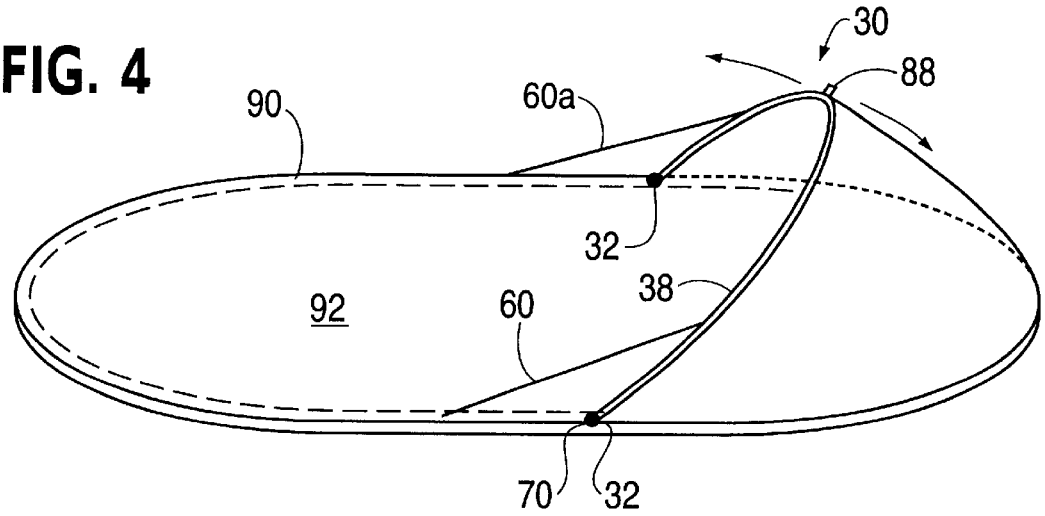
FIG. 4 shows a perspective view of the apparatus according to another embodiment of the present invention.

In another embodiment of the invention (see, e.g., FIG. 4), the retainer 60 may be straps, or elastic bands or hinges coupled between the support element 38 and the first collapsible frame 90. The straps or elastic bands 60 could either be permanently attached to the membrane 92 or first collapsible frame 90 or, alternatively, removably coupled thereto. The straps 60 could be adjustable by virtue of their physical characteristics (e.g., elastic) or by virtue of their attachment point along the first collapsible frame 90.

In yet another embodiment of the invention (see, e.g., FIG. 5), the retainer 60 may include an inflatable member coupled between the support element 38 and the first collapsible frame 90. When the inflatable member 60 is inflated, it displaces the support element 38, thereby expanding the covering 50 and creating an enclosed space above the membrane 92. More than one inflatable member acting as a retainer 60 is possible. Moreover, the entire covering may be inflatable, thereby serving a dual purpose as a retainer 60 and a covering 50.

It also can be desirable to have a fastener 88 coupled to the support element 38 and the first collapsible frame 90 so the support element 38 is securely fastened to the first collapsible frame 90 when in the collapsed configuration. The fastener 88 may include such devices such as VELCRO®, buttons, snaps, zippers, hooks, temporary adhesive, and the like.

It is also possible for the pivotable connectors 32 on the support element 38 to be provided with ground anchors (not shown) so that the second collapsible frame 30 may be freestanding without being coupled to the first collapsible frame 90. In such a configuration, a ground anchor (not shown) may also be coupled to the covering 50 to ensure that the covering is securely fastened to the ground. Retainers 60 may also be coupled to the support element 38 to provide a more rigid attachment to the ground.

Figure 7:
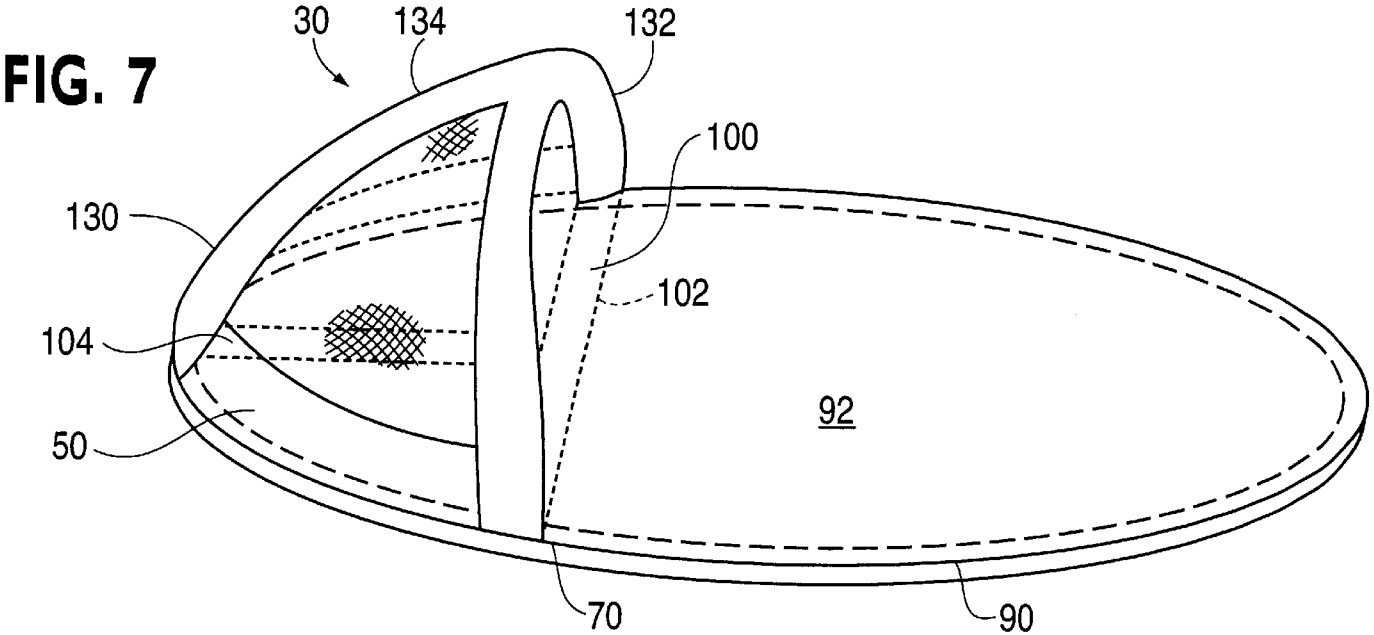
FIG. 7 shows a perspective view of the apparatus according to yet another embodiment of the present invention.

Referring, for example, to FIG. 7, a further embodiment of the invention is illustrated in which a first collapsible frame 90 can be formed from a flexible twistable material. A membrane 90, or covering, can be removably attachable to first collapsible frame 90. A second collapsible frame 30 can be engageable with the first collapsible frame 90. While the second collapsible frame 30 can be slidably engageable with the first collapsible frame 90, the second collapsible frame 30 can be coupled to the first collapsible frame 90 in other fashions. For example, the first collapsible frame 90 and second collapsible frame 30 could be provided with mating fasteners (not shown) to couple the two frames 90, 30 together. A covering 50 can be coupled to the second collapsible frame 30. The covering 50 and the second collapsible frame 30 together can be formable as an enclosure above the membrane 92.

It can be desirable for the second collapsible frame 30 to be formed from an inflatable construction such that the second collapsible frame 30 is arrangeable in at least one of either a collapsed configuration and an expanded configuration. When the inflatable construction 30 is in the collapsed configuration (see, e.g., FIG. 8) it can be substantially deflated and substantially flat. In such a configuration, the second collapsible frame 30 can be easily foldable and easily stored. When the inflatable construction 30 is in the expanded configuration, it is substantially inflated and it extends above the membrane 92 covering the first collapsible frame 90 (see, e.g., FIG. 7).

In a configuration where the second collapsible frame 30 slidably engages the first collapsible frame 90, it can be desirable to have a retention member 100 coupled to the second collapsible frame 30. The retention member 100 may be dimensioned such that it slidably engages the first collapsible frame 90. The retention assembly 100 may include, for example, a strap extending between opposite ends of the second collapsible frame 30. The strap may be elastic or may otherwise be adjustable to accommodate mats 20, 90 of various dimension while providing, for example, a snug friction fit between the two collapsible frames 90, 30.

Figure 8:
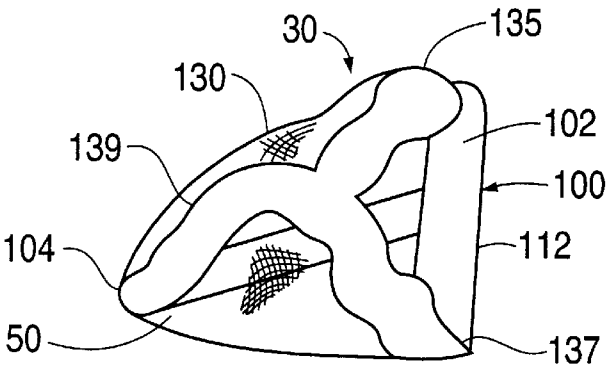
FIG. 8 shows a perspective view of a shade of the apparatus shown in FIG. 7 in a collapsed configuration.
Figure 9:
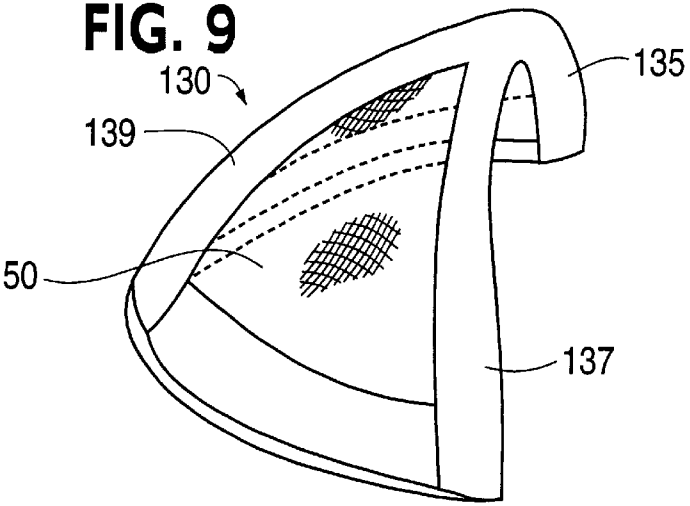
FIG. 9 shows a perspective view of the apparatus according to a further embodiment of the present invention.

Referring to FIGS. 8 and 9, the second collapsible frame 30 may be configured to be free standing from the first collapsible frame 90. In such a configuration, the apparatus 10, or shade, includes a collapsible frame member 130 having an arcuate member 132, and a strut member 134 extending from the arcuate member 132 such that a substantially three-legged structure is formed 130. The non-joined ends of the three-legged structure 130 can terminate substantially in a plane such that the collapsible frame member 130 is configured to rest upon a surface and thereby form a substantially half parabaloid-like structure. A covering 50 extends between opposite sides of the arcuate member 132 around the strut member 134. The shape of the strut member 134 dictates the shape the covering 50 will take around the collapsible frame 130. The opposing legs of the arcuate member 132 define an opening.

It can be desirable-to have a retention member 100 coupled to the arcuate member 132 and the strut member 134 opposite the covering 50 such that the collapsible frame member 130 may be removably coupled to mats or towels or the like. The retention member 100, as described above, may include elastic, or some other sort of adjustable strap so that the retention member 100 is expandable or contractible to fit mats and towels of various dimensions. The collapsible frame member 130 can be coupled at opposite sides of a first end 102 of the retention member 100. Also, the collapsible frame member 130 can be further coupled at a second end 104 of the retention member 100.

The collapsible frame member 130 can be inflatable such that it is arranged in either at least one of a collapsed configuration and an expandable configuration. In the collapsed configuration, the collapsible frame member 130 is substantially deflated and can be substantially flat. In such a configuration, the collapsible frame member 130 is easily folded into a small dimension and stored. In the expanded configuration, the collapsible frame member 130 defines a substantially three-legged structure that extends above a surface such as the ground, a towel, or a mat.

Referring to FIGS. 8 and 9, the apparatus 10 can include a first leg 135, a second leg 137, and a third leg 139. The first leg 135, second leg 137, and third leg 139 each have and end 150 adjacent to one another and a covering 50 can extend between at least two adjacent legs such that at least one opening is defined between two adjacent legs. Each of the legs 135, 137, 139 has a first end 150 and a second end 152, with each of the legs 135, 137, 139 being coupled to the others at the first end 150. The legs 135, 137, 139 may either be integrally formed or removably coupled. A retention member 100 can be coupled to the second end 152 of each of the legs 135, 137, 139. The retention member 100 may be, for example, a set of straps or a continuous sheet extending between the legs 135, 137, 139. The retention member 100 may also be integrally formed with the covering 50.

It can be desirable for the collapsible frame 130 to be inflatable as described above such that it is arranged in either at least one of a collapsed configuration and an expandable configuration. In the collapsed configuration, the collapsible frame member 130 is substantially deflated and can be substantially flat. In such a configuration, the collapsible frame member 130 can be easily folded into a small dimension and stored. In the expanded configuration, the collapsible frame member can define a substantially three-legged structure that extends above a surface such as the ground, a towel, or a mat.

Alternatively, one or more of the legs 135, 137, 139 can be filled with ballast such as sand or water to maintain the frame member 30 in position. The legs 135, 137, 139 for example, can be substantially hollow to accommodate ballast therein and may be either partially or completely fillable with ballast. Moreover, separate ballast tanks (not shown) can be coupled to the collapsible frame member 130 to maintain it in place.

Figure 11:
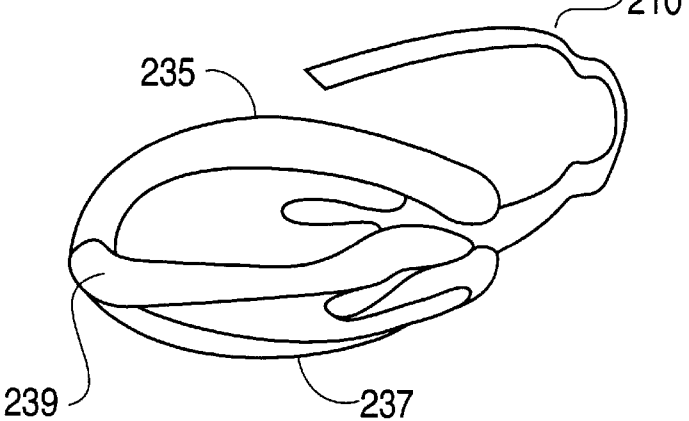
FIG. 11 shows a perspective view of the apparatus shown in FIG. 10
Figure 10:
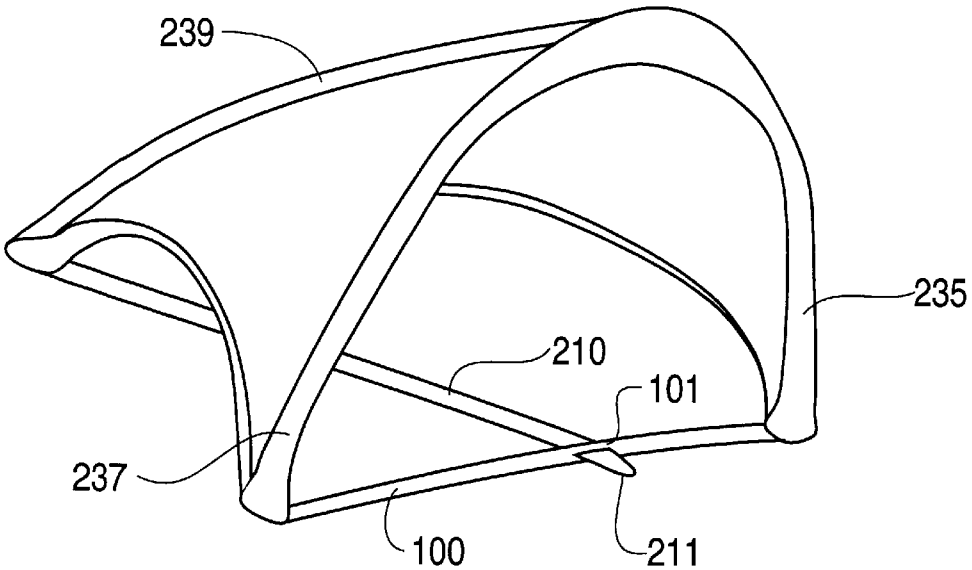
FIG. 10 illustrates a perspective view of an apparatus according to another embodiment of the present invention.

FIG. 10 illustrates a perspective view of an apparatus according to another embodiment of the present invention. FIG. 11 shows a perspective view of the apparatus shown in FIG. 10 in a collapsed configuration. Shade 200 shown in FIG. 10 includes a strap 210 shown in FIG. 11. Strap 210 includes a tab 211 that is disposed through a slot 101 in retention member 100. By pulling the tab 211 through slot 101, strap 210 is pulled through slot 101 thereby automatically deflating the inflatable members 35, 237 and 239 and thereby collapsing shade 200.

Figure 12:
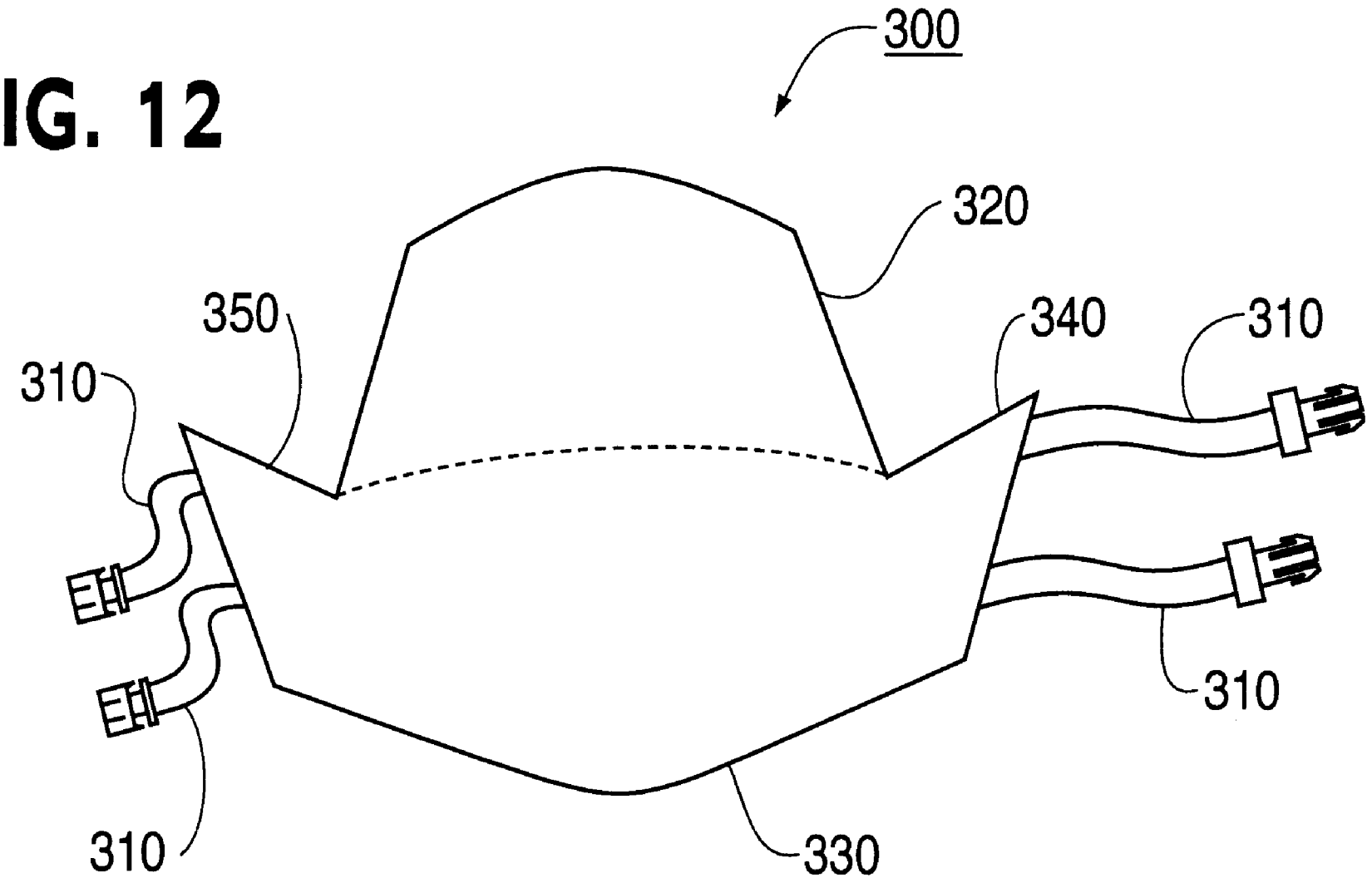
FIG. 12 shows a top view of an apparatus according to another embodiment of the present invention.

FIG. 12 shows a top view of an apparatus according to another embodiment of the present invention. Shade 300 includes straps 310, top portion 320, central portion 330 and extended portions 340 and 350. The shade 300 can be made for example, of a corrugated plastic and can be scored where the central portion 330 meets the top portion 320 and meets the extended portions 340 and 350. Consequently, the top portion 320 can be folded towards the central portion 330 at the scoring, and the extended portions 340 and 350 can be folded towards the central portion 330 at the respectively scoring. Thus, shade 300 can be converted from a planar configuration into an upright configuration.

When shade 300 is in an upright configuration, shade 300 can be used in conjunction with, for example, a blanket or mat. More specifically, top portion 320 can be folded over and onto central portion 330 and extended portions 340 and 350 can be folded towards central portion 330 thereby forming a canopy-like structure. In other words, the central portion 330 and the folded over top portion 320 can be elevated by the extended portions 340 and 350. The straps 310 can be connected to maintain the canopy-like structure of shade 300.

Figure 13:
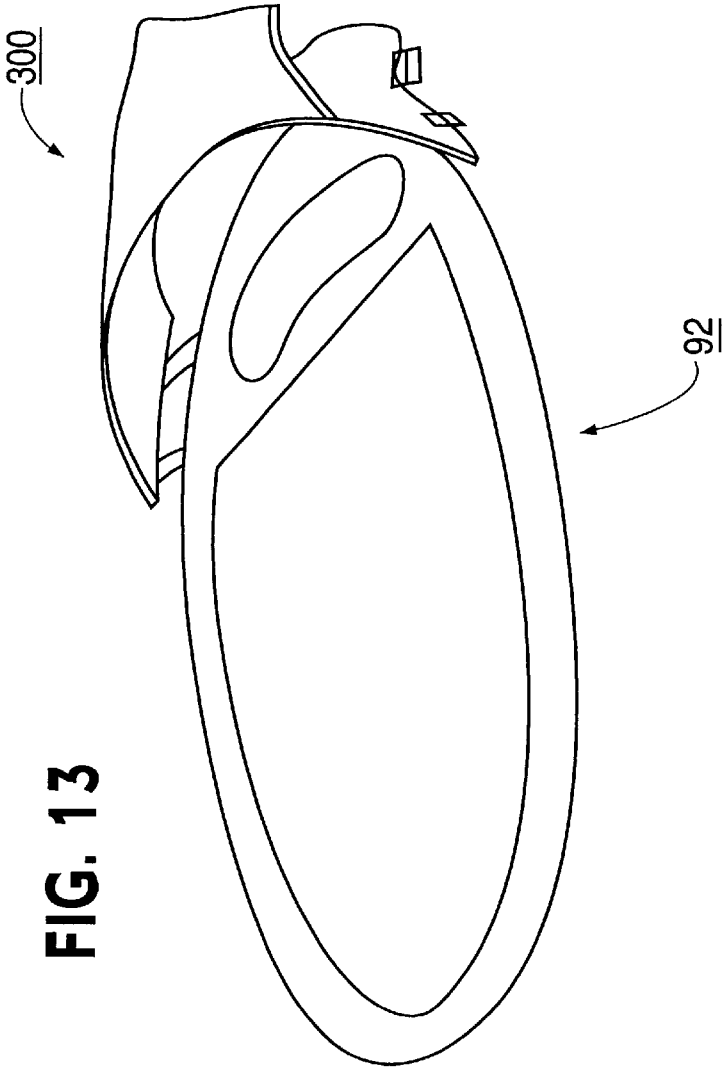
FIG. 13 shows a perspective view of the shade shown in FIG. 12 used in combination with a beach towel.

FIG. 13 shows a perspective view of the shade used in combination with a beach towel. More specifically, shade 300 is shown in use with a blanket 92 where the straps are attached together and the blanket disposed on top of the connected straps 310 and below the shade central portion 330 the folded over top portion 320.

Figure 14:
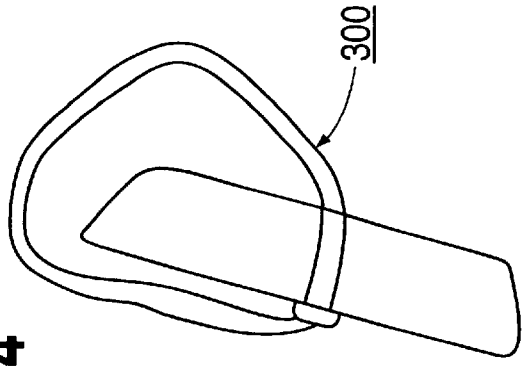
FIG. 14 shows a side view of the shade shown in FIG. 12 in a cylindrical configuration.

FIG. 14 shows a side view of the shade shown in FIG. 12 in a cylindrical configuration. More specifically, shade 300 can be rolled in a cylinder like shape and then held together by the straps 310, which can also be used as a handle while in the cylindrical configuration. Again, because shade 300 is corrugated, the shade 300 is possible that it can be rolled up into a cylindrical configuration shown, for example, in FIG. 14.

Figure 15:
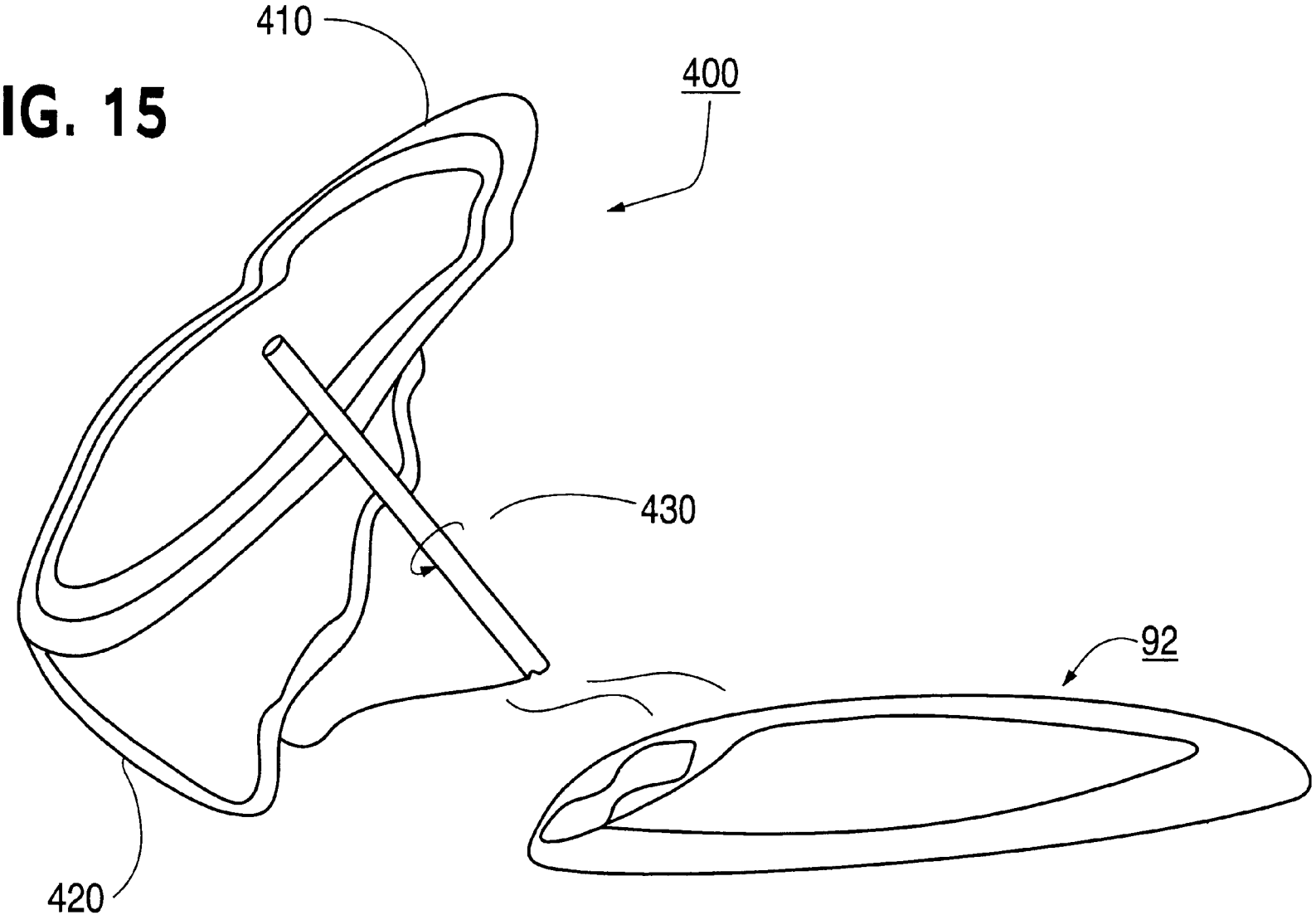
FIG. 15 shows a perspective view of an apparatus, according to yet another embodiment of the present invention.

FIG. 15 shows a perspective view of an apparatus, according to yet another embodiment of the present invention. Shade 400 includes carrying case 410, strap 420 and collapsible pole 430. Towel 92 can be stored, for example, in a storage apparatus 410 and contained within 410, for example, by a zipper on a parameter portion of carrying case 410. The pole 430 can be collapsible, for example, having a hollowed tube-like portions connected by an elastic center band. Such a pole 430 can then be collapsed to a small configuration and contained within carrying bag 410, or pole 430 can be extended and then prop up carrying device 410 to thereby provide shade from the sun for mat 92.

Figure 16:
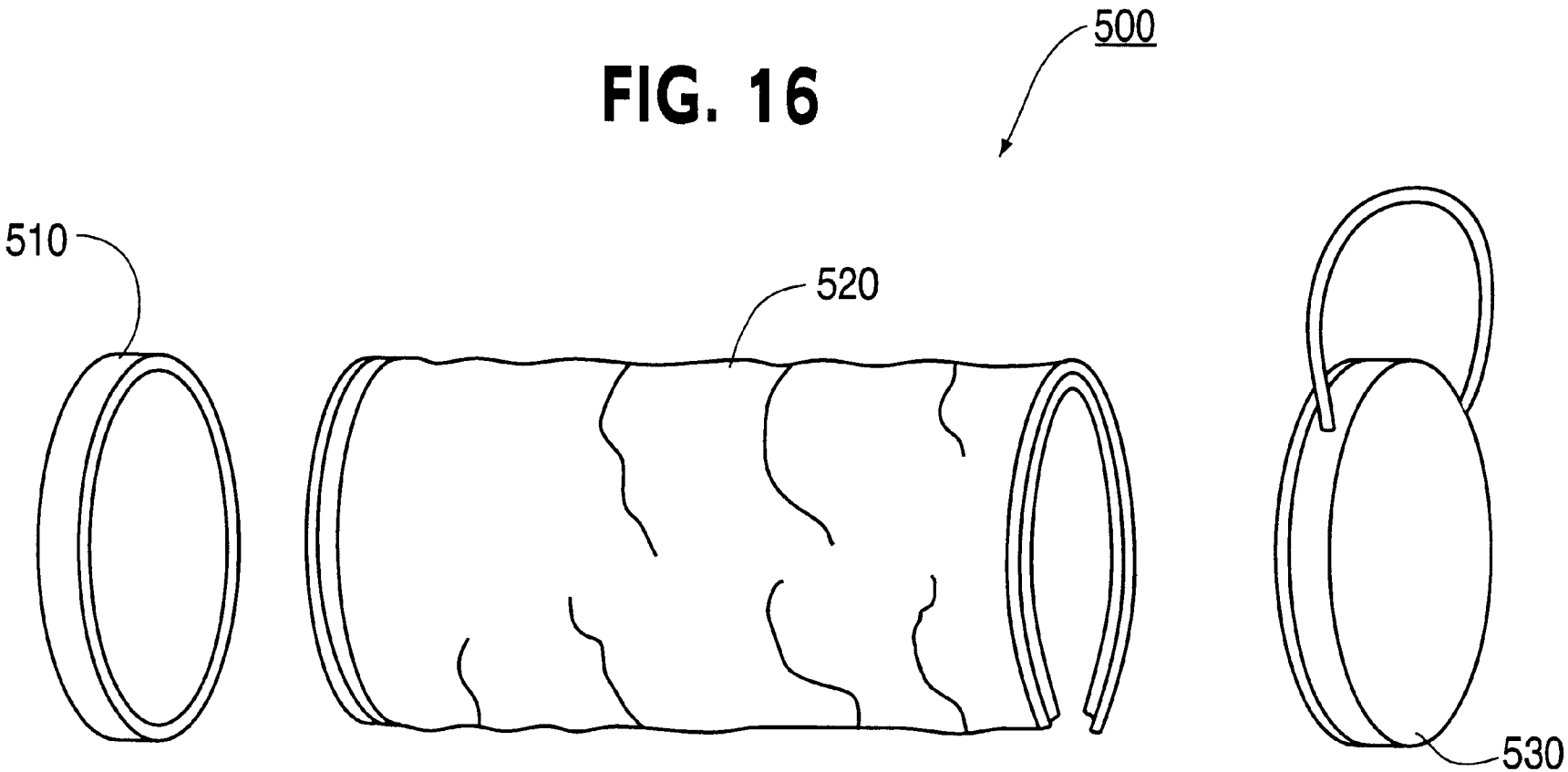
FIG. 16 shows a perspective view of an apparatus according to yet another embodiment of the present invention.

FIG. 16 shows a perspective view of an apparatus according to yet another embodiment of the present invention. Sunshade 500 includes an end portion 510, center portion 520 and end portion 530. End portion 510 can include an attachment device so that it attaches to one end of center portion 520; similarly, end portion 530 can include an attachment device so that it attaches to the other end of center portion 520. The attachment device can be for example a zipper set or velcro attachment where the end portions 510 and 530 can be removably attached to the respective ends of center portion 520.

Center portion 520 can be easily laterally collapsed (i.e., collapsed towards attached end portions 510 and 530) to a substantially planar shape so that the entire structure (i.e., center portion 520 and attached end portions 510 and 530) are in a substantially planar shape for easy transport. In fact, in such a configuration a towel mat, such as towel mat 92 described above, can be inserted into center portion 520 and contained within the substantially planar configuration of center portion 520 and attached end portions 510 and 530. End portions 510 and 530 can have a relatively rigid shape so that they can be placed for example a sandy beach. End portions 510 and 530 can each include, for example, a rigid frame member fixedly attached to the perimeter of end portion.

Figure 17:
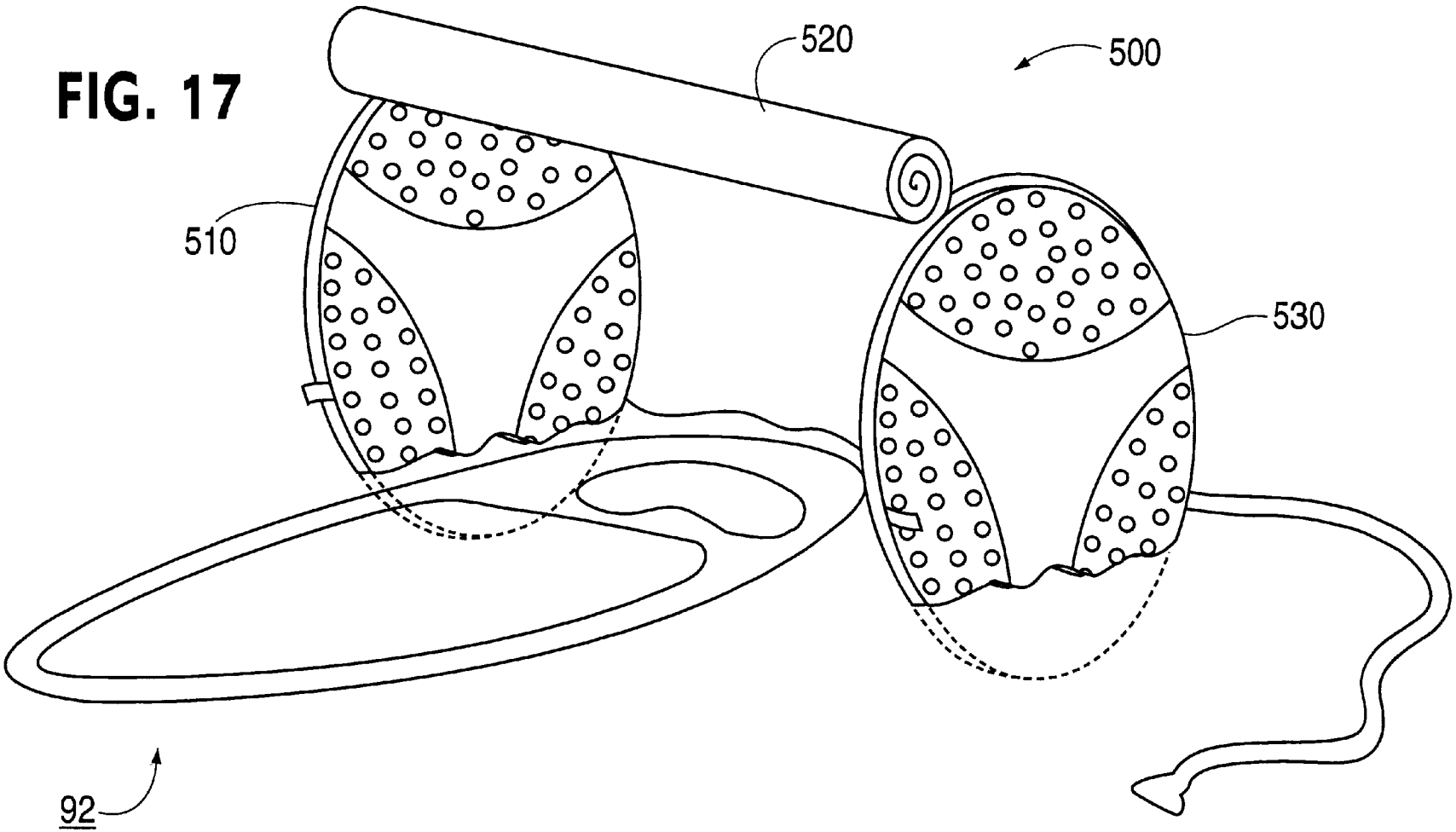
FIG. 17 shows the shade of FIG. 16 in a shade configuration with a towel mat.

FIG. 17 shows the shade of FIG. 16 in a shade configuration with a towel mat.

As FIG. 17 shows, center portion 520 can be removably attached along a portion of end portions 510 and 530. The portion of center portion 520 which is not attached to end portions 510 and 530 can be rolled into a relatively compact cylindrical space such that the portion of central portion 520 which is attached to end portions 510 and 530 acts as a shade. The portion of central portion 520 not attached to end portions 510 and 530 allows an opening for a person to lay on mat 92 inside the volume created by sunshade 500. Note that end portions 510 and 530 can be located in a stable manner with respect to mat 92 by placing a portion of the end portions 510 and 530 into the ground, for example, on a sandy beach. Such inserted portions of end portions 510 and 530 are shown in FIG. 17 for illustration purposes with the dotted outline.

It will be apparent to those skilled in the art that various modifications and variations can be made in the shade of the present invention without departing from the spirit or scope of the invention. Thus, it is intended that the present invention cover the modifications and variations of this invention provided they come within the scope of the appended claims and their equivalents. For example, any of the shades of the present invention can be used as free standing shades or together with a towel as described above.

What is claimed is:

1. A screen removably attachable to a ground cover, comprising:

a collapsible frame having pivotable connectors coupleable with a ground cover;

said collapsible frame having a first frame member having a substantially arcuate shape; and a second frame member having free ends and being pivotally coupled with said first frame member at a pair of pivot points separate from said pivotable connectors and said free ends;

a covering surrounding a portion of said collapsible frame, said collapsible frame and said covering together formable as an enclosure.

2. The screen of claim 1, wherein said first frame member and said second frame member are arrangeable in one of a collapsed configuration and an expanded configuration, wherein in the collapsed configuration, said first frame member and said second frame member are substantially coplanar; and in the expanded configuration, said first frame member, and said second frame member are offset from each other.

3. The screen of claim 2, wherein in said collapsed configuration, said second frame member is elongated.

4. The screen of claim 2, wherein in said expanded configuration, said second frame member is substantially circular in configuration.

5. An apparatus comprising:

a first collapsible frame being formed from a flexible twistable material, said first collapsible frame having a plurality of attachment points;

a membrane being removably attachable to said first collapsible frame;

a second collapsible frame having connectors being removably attachable to the plurality of attachment points; and a covering coupled with said second collapsible frame, said second collapsible frame and said covering together formable as an enclosure disposed over at least a portion of said membrane.

6. The apparatus of claim 5, wherein said second collapsible frame includes:

a first frame member having a substantially arcuate shape;

a second frame member pivotally coupled with said first frame member at a pair of pivot points such that said second frame member is arrangeable in one of a collapsed configuration and an expanded configuration, wherein in the collapsed configuration, said first frame member and said second frame member are substantially coplanar; and in the expanded configuration, said first frame member, and said second frame member are offset from each other.

7. The apparatus of claim 6, wherein in said collapsed configuration, said second frame member is elongated.

8. The apparatus of claim 6, wherein in said expanded configuration, said second frame member is substantially circular in configuration.

9. The apparatus of claim 5, wherein said second collapsible frame comprises at least one support element coupled to opposite sides of said first collapsible frame, such that said second collapsible frame is arrangeable in one of a collapsed configuration and an expanded configuration, wherein in the collapsed configuration, said support element substantially engages said membrane; and in the expanded configuration, said support element is substantially displaced from said membrane.

10. The apparatus of claim 9, further comprising:

a retainer coupled to said support element.

11. The apparatus of claim 10, wherein said retainer comprises a detent mechanism in said connectors.

* * * * *